US010215174B2

(12) United States Patent
Stover et al.

(10) Patent No.: US 10,215,174 B2
(45) Date of Patent: Feb. 26, 2019

(54) CO-ROTATING COMPRESSOR WITH MULTIPLE COMPRESSION MECHANISMS

(71) Applicant: Emerson Climate Technologies, Inc., Sidney, OH (US)

(72) Inventors: Robert C. Stover, Versailles, OH (US); Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 110 days.

(21) Appl. No.: 15/425,374

(22) Filed: Feb. 6, 2017

(65) Prior Publication Data

US 2018/0223842 A1 Aug. 9, 2018

(51) Int. Cl.
*F04C 18/02* (2006.01)
*F04C 23/00* (2006.01)
(Continued)

(52) U.S. Cl.
CPC ..... *F04C 18/023* (2013.01); *F04C 23/001* (2013.01); *F04C 23/008* (2013.01);
(Continued)

(58) Field of Classification Search
CPC ..... F04C 11/001; F04C 11/003; F04C 11/008; F04C 23/008; F04C 29/0085; F04C 29/02;
(Continued)

(56) References Cited

U.S. PATENT DOCUMENTS 4,105,374 A 8/1978 Scharf
4,781,550 A 11/1988 Morishita et al.
(Continued)

FOREIGN PATENT DOCUMENTS

JP H02140477 A 5/1990
JP H02207190 A 8/1990
(Continued)

OTHER PUBLICATIONS

Office Action regarding U.S. Appl. No. 15/205,907, dated May 29, 2018.
(Continued)

*Primary Examiner* — Alexander B Comley
*Assistant Examiner* — Chirag Jariwala
(74) *Attorney, Agent, or Firm* — Harness, Dickey & Pierce, P.L.C.

(57) ABSTRACT

A compressor may include a shell, first and second compression mechanisms, and first and second motor assemblies. The first compression mechanism may include first and second compression members that are rotatable relative to the shell about first and second rotational axes, respectively. The first motor assembly may be disposed within the shell and may include a first rotor attached to the first compression member and surrounding the first and second compression members. The second compression mechanism may include third and fourth compression members that are rotatable relative to the shell about third and fourth rotational axes, respectively. The second motor assembly may be disposed within the shell and may include a second rotor attached to the third compression member and surrounding the third and fourth compression members.

25 Claims, 4 Drawing Sheets

(51) Int. Cl.
*F04C 29/00* (2006.01)
*F04C 29/12* (2006.01)
*F04C 29/02* (2006.01)

(52) U.S. Cl.
CPC ..... *F04C 29/0085* (2013.01); *F04C 29/02* (2013.01); *F04C 29/12* (2013.01); *F04C 2240/30* (2013.01); *F04C 2240/40* (2013.01); *F04C 2240/50* (2013.01); *F04C 2240/52* (2013.01); *F04C 2240/809* (2013.01)

(58) Field of Classification Search
CPC ..... F04C 2240/30; F04C 2240/40; F04C 2240/50; F04C 2240/809; F04C 18/023; F04C 23/001; F04C 29/12; F04C 2240/52; F04B 23/04; F04B 23/12; F04B 17/03; F04B 35/04; F04B 41/06; F04D 13/12; F04D 13/14; F04D 25/16; F04D 25/166; H02K 16/00
USPC ..... 417/2, 16, 286, 355, 356, 410.4, 410.5, 417/521, 522; 418/35, 9, 55.1–55.6, 57, 418/60, 200, 215, 216, 220
See application file for complete search history.

(56) References Cited

U.S. PATENT DOCUMENTS

| | | | | |
|---|---|---|---|---|
| 4,846,639 | A | 7/1989 | Morishita et al. | |
| 5,073,093 | A | 12/1991 | Takagi et al. | |
| 5,090,876 | A | 2/1992 | Hashizume et al. | |
| 5,099,658 | A | 3/1992 | Utter et al. | |
| 5,129,798 | A | 7/1992 | Crum et al. | |
| 5,211,031 | A * | 5/1993 | Murayama | F04C 23/001 417/3 |
| 5,256,042 | A | 10/1993 | McCullough et al. | |
| 5,256,044 | A | 10/1993 | Nieter et al. | |
| 5,713,731 | A | 2/1998 | Utter et al. | |
| 5,791,883 | A | 8/1998 | Ban et al. | |
| 6,359,357 | B1 | 3/2002 | Blumenstock | |
| 6,616,430 | B2 | 9/2003 | Mori et al. | |
| 6,712,589 | B2 * | 3/2004 | Mori | F01C 17/063 417/410.5 |
| 7,201,567 | B2 | 4/2007 | Wiertz et al. | |
| 7,344,367 | B2 | 3/2008 | Manole | |
| 8,058,762 | B2 | 11/2011 | Asano | |
| 8,179,016 | B2 | 5/2012 | Asano | |
| 8,373,326 | B2 | 2/2013 | Enomoto et al. | |
| 8,894,388 | B2 | 11/2014 | Lee et al. | |
| 2002/0182094 | A1 | 12/2002 | Mori et al. | |
| 2008/0087033 | A1 | 4/2008 | Bae et al. | |
| 2009/0104060 | A1 * | 4/2009 | Sato | F04C 18/0215 418/5 |
| 2010/0164313 | A1 | 7/2010 | Langford et al. | |
| 2010/0225195 | A1 | 9/2010 | Asano et al. | |
| 2011/0002797 | A1 | 1/2011 | Takeuchi et al. | |
| 2011/0038737 | A1 | 2/2011 | Conry et al. | |
| 2012/0131945 | A1 | 5/2012 | Huang et al. | |
| 2013/0181565 | A1 | 7/2013 | Petro et al. | |
| 2016/0043602 | A1 | 2/2016 | Hosek et al. | |
| 2018/0013336 | A1 | 1/2018 | Li | |
| 2018/0223843 | A1 | 8/2018 | Doepker et al. | |
| 2018/0223848 | A1 | 8/2018 | Doepker et al. | |
| 2018/0223849 | A1 | 8/2018 | Doepker et al. | |
| 2018/0224171 | A1 | 8/2018 | Doepker et al. | |

FOREIGN PATENT DOCUMENTS

| | | | |
|---|---|---|---|
| JP | H07229481 | A | 8/1995 |
| JP | 2004052657 | A | 2/2004 |
| JP | 2015124653 | A | 7/2015 |

OTHER PUBLICATIONS

International Search Report of the ISA regarding International Patent Application No. PCT/US2018/017069, dated Jun. 12, 2018.
Written Opinion of the ISA regarding International Patent Application No. PCT/US2018/017069, dated Jun. 12, 2018.
Frank, et al., NASA Tech Briefs, Ring Motors—Design Flexibility for Innovative Configurations, Sep. 1, 2014.
McMullen, et al., Combination Radial-Axial Magnetic Bearing, Seventh International Symp. On Magnetic Bearings, Aug. 23-25, 2000.
"Design of Electric Machines: Axial Flux Machines," Electric Energy Magazine No. 4, Jan.-Jun. 2013, 23 pages.
Mahmoudi, Rahim and Hew, "Axial-flux permanent-magnet machine modeling, design, simulation and analysis," Scientific Research and Essays vol. 6 (12), Jun. 18, 2011, pp. 2525-2549.
U.S. Appl. No. 15/877,870, filed Jan. 23, 2018, Roy J. Doepker et al.
Partial Search Report regarding European Patent Application No. 18155358.7, dated Jun. 27, 2018.
Search Report regarding European Patent Application No. 18155363.7, dated Jul. 2, 2018.
Search Report regarding European Patent Application No. 18155362.9, dated Jul. 2, 2018.
Election/Restriction Requirement regarding U.S. Appl. No. 15/425,428, dated Aug. 8, 2018.
U.S. Appl. No. 16/114,912, filed Aug. 28, 2018, Roy J. Doepker et al.
Office Action regarding U.S. Appl. No. 15/425,428, dated Nov. 1, 2018.

* cited by examiner

CO-ROTATING COMPRESSOR WITH MULTIPLE COMPRESSION MECHANISMS

FIELD

The present disclosure relates to compressors, and more particularly, to co-rotating compressors with multiple compression mechanisms.

BACKGROUND

This section provides background information related to the present disclosure and is not necessarily prior art.

A compressor may be used in a refrigeration, heat pump, HVAC, or chiller system (generically, "climate control system") to circulate a working fluid therethrough. The compressor may be one of a variety of compressor types. For example, the compressor may be a scroll compressor, a rotary-vane compressor, a reciprocating compressor, a centrifugal compressor, or an axial compressor. Some compressors include a motor assembly that rotates a driveshaft. In this regard, compressors often utilize a motor assembly that includes a stator surrounding a central rotor that is coupled to the driveshaft below the compression mechanism. Regardless of the exact type of compressor employed, consistent and reliable operation of the compressor is desirable to effectively and efficiently circulate the working fluid through the climate control system. The present disclosure provides an improved, compact compressor having multiple motor assemblies that efficiently and effectively drive multiple compression mechanisms.

SUMMARY

This section provides a general summary of the disclosure, and is not a comprehensive disclosure of its full scope or all of its features.

The present disclosure provides a compressor that may include a shell (e.g., a shell assembly), a first compression mechanism, a first motor assembly, a second compression mechanism, and a second motor assembly. The first compression mechanism is disposed within the shell and may include a first compression member that is rotatable relative to the shell about a first rotational axis and a second compression member that is rotatable relative to the shell about a second rotational axis that is parallel to and offset from the first rotational axis. The first motor assembly may be disposed within the shell and may include a first rotor attached to the first compression member and surrounding the first and second compression members. The second compression mechanism is disposed within the shell and may include a third compression member that is rotatable relative to the shell about a third rotational axis and a fourth compression member that is rotatable relative to the shell about a fourth rotational axis that is parallel to and offset from the third rotational axis. The second motor assembly may be disposed within the shell and may include a second rotor attached to the third compression member and surrounding the third and fourth compression members.

In some configurations, the first, second, third and fourth compression members are scroll members each having an end plate and a spiral wrap extending from the end plate.

In some configurations, the first and third rotational axes are collinear, and the second and fourth rotational axes are collinear.

In some configurations, the first and second motor assemblies are operable independently of each other, and the first and second rotors are rotatable independently of each other.

In some configurations, the first compression mechanism receives and further compresses fluid discharged from the second compression mechanism. That is, the fluid may be discharge from the second compression mechanism and may be received by the first compression mechanism without exiting the compressor.

In some configurations, the compressor includes a first bearing housing, a second bearing housing, and a third bearing housing. The first bearing housing is disposed within the shell and rotatably supports a first hub of the first compression member. The second bearing housing is disposed within the shell and rotatably supports a second hub of the second compression member and a fourth hub of the fourth compression member. The third bearing housing is disposed within the shell and rotatably supports a third hub of the third compression member.

In some configurations, the fourth hub of the fourth compression member includes a discharge passage through which fluid compressed by the second compression mechanism flows. The second hub of the second compression member may include an inlet passage that receives fluid from the discharge passage. The second bearing housing may include an aperture that provides fluid communication between the discharge passage and the inlet passage.

In some configurations, an end plate of the second compression member includes a radially extending passage in fluid communication with the inlet passage and a pocket defined by spiral wraps of the first and second compression members.

In some configurations, the first bearing housing cooperates with the shell to define a first discharge chamber receiving fluid discharged by the first compression mechanism. The third bearing housing may cooperate with the shell to define a second discharge chamber receiving fluid discharged by the second compression mechanism.

In some configurations, the first and third bearing housings cooperate to define a suction chamber therebetween. The first and second compression mechanisms receive fluid from the suction chamber at a pressure that is lower than a pressure of the fluid in at least one of the first and second discharge chambers.

In some configurations, the compressor includes a discharge conduit extending through the suction chamber and providing fluid communication between the first and second discharge chambers. In some configurations, the discharge conduit may be defined by the first, second and third bearing housings.

In some configurations, the shell defines a lubricant sump disposed in the second discharge chamber. The first, second and third bearing housings may include lubricant passages in fluid communication with the lubricant sump and providing lubricant to the first, second, third and fourth compression members.

In some configurations, the first and second rotors each include a radially extending portion that extends radially outward relative to the first rotational axis and an axially extending portion that extends parallel to the first rotational axis. The axially extending portion of the first rotor may engage the first compression member and may surround the second compression member. The axially extending portion of the second rotor may engage the third compression member and may surround the fourth compression member.

In some configurations, the compressor includes a first seal engaging the second compression member and the radially extending portion of the first rotor; and a second seal engaging the fourth compression member and the radially extending portion of the second rotor. The radially extending portions of the first and second rotors may be disposed axially between end plates of the second and fourth compression members.

The present disclosure also provides a compressor that may include a shell (e.g., a shell assembly), a first compression mechanism, a first bearing housing, a second bearing housing, a first motor assembly, a second compression mechanism, a third bearing housing, and a second motor assembly. The first compression mechanism is disposed within the shell and may include a first compression member that is rotatable relative to the shell about a first rotational axis and a second compression member that is rotatable relative to the shell about a second rotational axis that is parallel to and offset from the first rotational axis. The first bearing housing may be fixed relative to the shell and may rotatably support a first hub of the first compression member. The second bearing housing may be fixed relative to the shell and may rotatably support a second hub of the second compression member. The first motor assembly may be disposed between the first and second bearing housings and may include a first rotor attached to the first compression member. The second compression mechanism may be disposed within the shell and may include a third compression member that is rotatable relative to the shell about a third rotational axis and a fourth compression member that is rotatable relative to the shell about a fourth rotational axis that is parallel to and offset from the third rotational axis. The fourth compression member may include a fourth hub that is rotatably supported by the second bearing housing. The third bearing housing may be fixed relative to the shell and may rotatably support a third hub of the third compression member. The second motor assembly may be disposed between the second and third bearing housings and may include a second rotor attached to the third compression member.

In some configurations, the first, second, third and fourth compression members are scroll members each having an end plate and a spiral wrap extending from the end plate.

In some configurations, the first rotor surrounds the first and second compression members, and the second rotor surrounds the third and fourth compression members.

In some configurations, the first and third rotational axes are collinear, and the second and fourth rotational axes are collinear.

In some configurations, the first and second motor assemblies are operable independently of each other, and the first and second rotors are rotatable independently of each other.

In some configurations, the first compression mechanism receives and further compresses fluid discharged from the second compression mechanism. That is, the fluid may be discharge from the second compression mechanism and may be received by the first compression mechanism without exiting the compressor.

In some configurations, the fourth hub of the fourth compression member includes a discharge passage through which fluid compressed by the second compression mechanism flows. The second hub of the second compression member may include an inlet passage that receives fluid from the discharge passage. The second bearing housing may include an aperture that provides fluid communication between the discharge passage and the inlet passage.

In some configurations, an end plate of the second compression member includes a radially extending passage in fluid communication with the inlet passage and a pocket defined by spiral wraps of the first and second compression members.

In some configurations, the first bearing housing cooperates with the shell to define a first discharge chamber receiving fluid discharged by the first compression mechanism. The third bearing housing may cooperate with the shell to define a second discharge chamber receiving fluid discharged by the second compression mechanism.

In some configurations, the first and third bearing housings cooperate to define a suction chamber therebetween. The first and second compression mechanisms may receive fluid from the suction chamber at a pressure that is lower than a pressure of the fluid in at least one of the first and second discharge chambers.

In some configurations, the compressor includes a discharge conduit extending through the suction chamber and providing fluid communication between the first and second discharge chambers. In some configurations, the discharge conduit may be defined by the first, second and third bearing housings.

In some configurations, the shell defines a lubricant sump disposed in the second discharge chamber. The first, second and third bearing housings may include lubricant passages in fluid communication with the lubricant sump and providing lubricant to the first, second, third and fourth compression members.

In some configurations, the first and second rotors each include a radially extending portion that extends radially outward relative to the first rotational axis and an axially extending portion that extends parallel to the first rotational axis. The axially extending portion of the first rotor may engage the first compression member and surrounds the second compression member. The axially extending portion of the second rotor may engage the third compression member and may surround the fourth compression member.

In some configurations, the compressor includes a first seal engaging the second compression member and the radially extending portion of the first rotor; and a second seal engaging the fourth compression member and the radially extending portion of the second rotor. The radially extending portions of the first and second rotors may be disposed axially between end plates of the second and fourth compression members.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
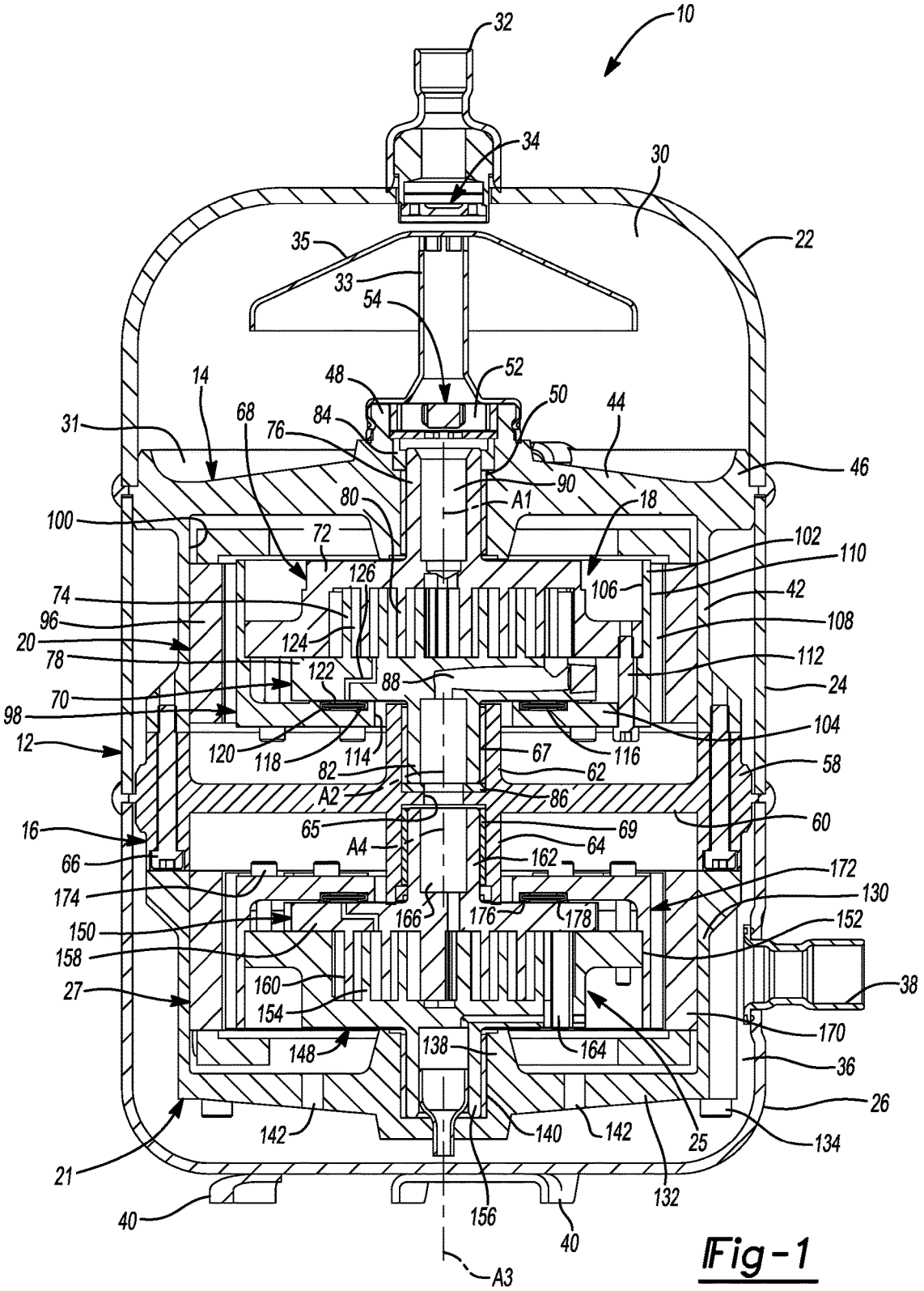
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
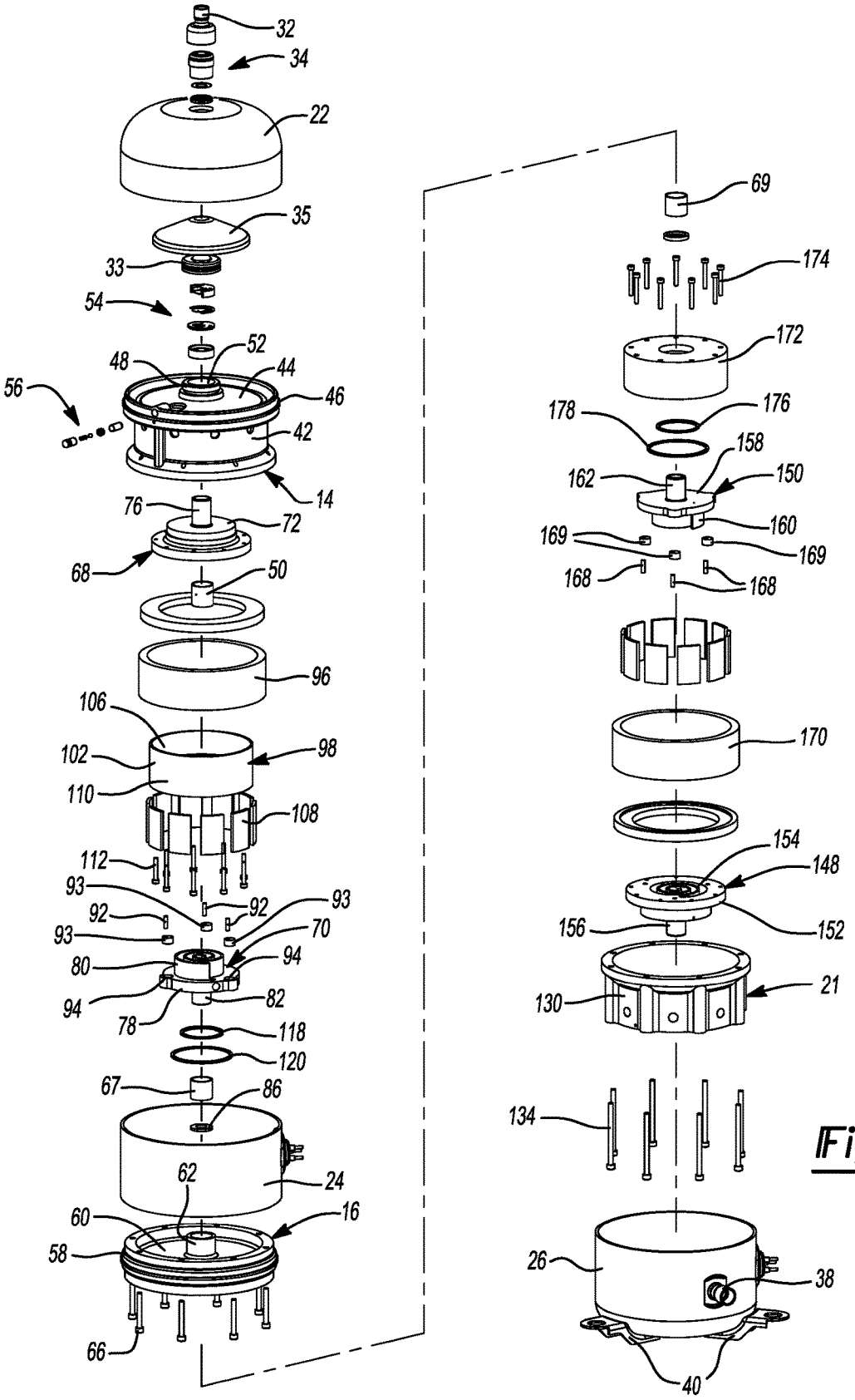
FIG. 2 is an exploded view of the compressor of FIG. 1.

With reference to FIGS. 1 and 2, a compressor 10 is provided that may include a shell assembly 12, a first bearing housing 14, a second bearing housing 16, a first compression mechanism 18, a first motor assembly 20, a third bearing housing 21, a second compression mechanism 25, and a second motor assembly 27. The shell assembly 12 may include a first shell body 22, a second shell body 24 and a third shell body 26. The first and second shell bodies 22, 24 may be fixed to the first bearing housing 14 and to each other (e.g., with the first shell body 22 stacked on top of the second shell body 24). The first shell body 22 and the first bearing housing 14 may cooperate with each other to define a discharge chamber 30. The first bearing housing 14 may sealingly engage the first and second shell bodies 22, 24 to seal the discharge chamber 30 within the first shell body 22. A discharge outlet fitting 32 may engage the first shell body 22 and may be in fluid communication with the discharge chamber 30. Discharge-pressure working fluid (i.e., working fluid at a higher pressure than suction pressure) may enter the discharge chamber 30 from the first compression mechanism 18 and may exit the compressor 10 through the discharge outlet fitting 32. In some configurations, a discharge valve 34 may be disposed within the discharge outlet fitting 32. The discharge valve 34 may be a check valve that allows fluid to exit the discharge chamber 30 through the discharge outlet fitting 32 and prevents fluid from entering the discharge chamber 30 through the discharge outlet fitting 32. In some configurations, the first shell body 22 and the first bearing housing 14 may define a lubricant sump 31 disposed in the discharge chamber 30. A mixture of discharge-pressure working fluid and lubricant may be discharged from the first compression mechanism 18 through a discharge pipe 33 mounted to the first bearing housing 14. The discharge pipe 33 may direct the mixture of discharge-pressure working fluid and lubricant to a lubricant separator 35 that separates the lubricant from the discharge-pressure working fluid. The separated lubricant may fall from the lubricant separator 35 into the lubricant sump 31 and the separated discharge-pressure working fluid may flow toward the discharge outlet fitting 32.

The second and third shell bodies 24, 26 may be fixed to the second bearing housing 16 and to each other (e.g., with the second shell body 24 stacked on top of the third shell body 26). The third shell body 26 and the second bearing housing 16 may cooperate with each other to define a suction chamber 36 in which the third bearing housing 21 may be disposed. The second bearing housing 16 may sealingly engage the second and third shell bodies 24, 26 to seal the suction chamber 36 within the third shell body 26. A suction inlet fitting 38 may engage the third shell body 26 and may be in fluid communication with the suction chamber 36. Suction-pressure working fluid (i.e., low-pressure working fluid) may enter the suction chamber 36 through the suction inlet fitting 38 and may be drawn into the second compression mechanism 25 for compression therein. In some configurations, the third shell body 26 may define a lubricant sump disposed in the suction chamber 36. The third shell body 26 may include feet (or mounting flanges) 40 and may define a base of the shell assembly 12.

The first bearing housing 14 may include a generally cylindrical annular wall 42 and a radially extending flange portion 44 disposed at an axial end of the annular wall 42. The flange portion 44 may include an outer rim 46 that is welded to (or otherwise fixedly engages) the first and second shell bodies 22, 24. The flange portion 44 may include a central hub 48 that receives a first bearing 50. The discharge pipe 33 may be mounted to the central hub 48. The central hub 48 may define a discharge passage 52 through which discharge-pressure working fluid flows from the first compression mechanism 18 to the discharge pipe 33 and into the discharge chamber 30. A discharge valve assembly 54 (e.g., a check valve) may be disposed within the discharge passage 52 and may allow fluid flow from the first compression mechanism 18 to the discharge chamber 30 and prevent fluid flow from the discharge chamber 30 to the first compression mechanism 18.

In some configurations, the first bearing housing 14 may include one or more lubricant passages (not shown) in fluid communication with the lubricant sump 31. A valve assembly 56 (e.g., a check valve assembly; show in FIG. 2) may be mounted to the first bearing housing 14 and may selectively allow and prevent lubricant to flow from the lubricant sump 31 and through the one or more lubricant passages to various components (e.g., bearings and scroll members) of the compressor 10.

The second bearing housing 16 may be a generally cylindrical member having an annular outer wall 58, disk-shaped body 60 extending radially inward from the annular outer wall 58, a first central hub 62 extending axially upward from a first side of the body 60, and a second central hub 64 that extends axially downward from a second opposite side of the body 60. The second bearing housing 16 may include a central aperture 65 that is open to interiors of the first and second central hubs 62, 64. The first central hub 62 may receive a second bearing 67 (i.e., the second bearing 67 is disposed in the interior of the first central hub 62). The second central hub 64 may receive a third bearing 69 (i.e., the third bearing 69 is disposed in the interior of the second central hub 64). The annular outer wall 58 of the second bearing housing 16 may be fixedly attached to an axial end of the annular wall 42 of the first bearing housing 14 via a plurality of fasteners 66, for example. In some configurations, the second bearing housing 16 may include one or more lubricant passages (not shown) in fluid communication with one or more lubricant passages (not shown) in the first bearing housing 14 to provide lubricant from the lubricant sump 31 to bearings, for example.

The first compression mechanism 18 may include a first compression member and a second compression member that cooperate to define fluid pockets (i.e., compression pockets) therebetween. For example, the first compression mechanism 18 may be a co-rotating scroll compression mechanism in which the first compression member is a first scroll member (i.e., a driven scroll member) 68 and the second compression member is a second scroll member (i.e., an idler scroll member) 70. In other configurations, the first compression mechanism 18 could be another type of compression mechanism, such as an orbiting scroll compression mechanism, a rotary compression mechanism, a screw compression mechanism, a Wankel compression mechanism or a reciprocating compression mechanism, for example.

The first scroll member 68 may include a first end plate 72, a first spiral wrap 74 extending from one side of the first end plate 72, and a first hub 76 extending from the opposite side of the first end plate 72. The second scroll member 70 may include a second end plate 78, a second spiral wrap 80 extending from one side of the second end plate 78, and a second hub 82 extending from the opposite side of the second end plate 78. The first hub 76 of the first scroll member 68 is received within the central hub 48 of the first bearing housing 14 and is supported by the first bearing housing 14 and the first bearing 50 for rotation about a first rotational axis A1 relative to the first and second bearing housings 14, 16. A seal 84 is disposed within the central hub 48 and sealing engages the central hub 48 and the first hub 76. The second hub 82 of the second scroll member 70 is received within the first central hub 62 of the second bearing housing 16 and is supported by the second bearing housing 16 and the second bearing 67 for rotation about a second rotational axis A2 relative to the first and second bearing housings 14, 16. The second rotational axis A2 is parallel to first rotational axis A1 and is offset from the first rotational axis A1. A thrust bearing 86 may be disposed within the first central hub 62 of the second bearing housing 16 and may support an axial end of the second hub 82 of the second scroll member 70.

The first and second spiral wraps 74, 80 are intermeshed with each other and cooperate to form a plurality of fluid pockets (i.e., compression pockets) therebetween. Rotation of the first scroll member 68 about the first rotational axis A1 and rotation of the second scroll member 70 about the second rotational axis A2 causes the fluid pockets to decrease in size as they move from a radially outer position to a radially inner position, thereby compressing the working fluid therein.

The second scroll member 70 may include a suction inlet passage 88 that extends through the second hub 82 and the second end plate 78 and is in fluid communication with a radially outermost one of the fluid pockets defined by the spiral wraps 74, 80. The first scroll member 68 may include a discharge passage 90 that extends through the first end plate 72 and the first hub 76 and provides fluid communication between a radially innermost one of the fluid pockets and the discharge chamber 30 (e.g., via the discharge passage 52).

In some configurations, the first compression mechanism 18 could include an Oldham coupling (not shown) that may be keyed to the first and second end plates 72, 78 or keyed to the second end plate 78 and a rotor 98 of the first motor assembly 20 to transmit motion of the first scroll member 68 to the second scroll member 70. In other configurations, the first compression mechanism 18 may include a transmission mechanism that includes a plurality of pins 92 (FIG. 2) attached to and extending axially from the first end plate 72 of first scroll member 68 (or from a rotor 98 of the first motor assembly 20). Each of the pins 92 may be received with an off-center aperture in a cylindrical disk 93 (FIG. 2; i.e., an eccentric aperture that extends parallel to and offset from a longitudinal axis of the cylindrical disk 93). The disks 93 may be rotatably received in a corresponding one of a plurality of recesses 94 (FIG. 2) formed in the second end plate 78 of the second scroll member 70. The recesses 94 may be positioned such that they are angularly spaced apart from each other in a circular pattern that surrounds the second rotational axis A2.

The first motor assembly 20 may be a ring-motor and may include a composite stator 96 and the rotor 98. The stator 96 may be an annular member fixed to an inner diametrical surface 100 of the annular wall 42 of the first bearing housing 14. The stator 96 may surround the first and second end plates 72, 78 and the first and second spiral wraps 74, 80.

The rotor 98 may be disposed radially inside of the stator 96 and is rotatable relative to the stator 96. The rotor 98 may include an annular axially extending portion 102 that extends parallel to the first rotational axis A1 and a radially extending portion 104 that extends radially inward (i.e., perpendicular to the first rotational axis A1) from an axial end of the axially extending portion 102. The axially extending portion 102 may surround the first and second end plates 72, 78 and the first and second spiral wraps 74, 80. An inner diametrical surface 106 of the axially extending portion 102 may engage an outer periphery of the first end plate 72. Magnets 108 may be fixed to an outer diametrical surface 110 of the axially extending portion 102. Fasteners 112 may engage the radially extending portion 104 and the first end plate 72 to rotationally and axially fix the rotor 98 to the first scroll member 68. Therefore, when electrical current is provided to the stator 96, the rotor 98 and the first scroll member 68 rotate about the first rotational axis A1. Such rotation of the first scroll member 68 causes corresponding rotation of the second scroll member 70 about the second rotational axis A2 due to the engagement of the pins 92 and disks 93 within the recesses 94 in the second scroll member 70.

The radially extending portion 104 of the rotor 98 may include a central aperture 114 through which the second hub 82 of the second scroll member 70 extends. The radially extending portion 104 may also include an annular recess 116 that surrounds the central aperture 114 and the first and second rotational axes A1, A2. A first annular seal 118 and a second annular seal 120 may be at least partially received in the recess 116 and may sealingly engage the radially extending portion 104 and the second end plate 78. The second annular seal 120 may surround the first annular seal 118. In this manner, the first and second annular seals 118, 120, the second end plate 78 and the radially extending portion 104 cooperate to define an annular chamber 122. The annular chamber 122 may receive intermediate-pressure working fluid (at a pressure greater than a pressure of working fluid received by the first compression mechanism 18 and less than a pressure of working fluid discharged from the first compression mechanism 18) from an intermediate fluid pocket 124 via a passage 126 in the second end plate 78. Intermediate-pressure working fluid in the annular chamber 122 biases the second end plate 78 in an axial direction (i.e., a direction parallel to the rotational axes A1, A2) toward the first end plate 72 to improve the seal between tips of the first spiral wrap 74 and the second end plate 78 and the seal between tips of the second spiral wrap 80 and the first end plate 72.

The third bearing housing 21 may include a generally cylindrical annular wall 130 and a radially extending flange portion 132 disposed at an axial end of the annular wall 130. The annular wall 130 of the third bearing housing 21 may be fixed to the annular outer wall 58 of the second bearing housing 16 via fasteners 134. The flange portion 132 may include a central hub 138 that receives a fourth bearing 140. The flange portion 132 may include one or more apertures 142 to allow fluid communication between the second compression mechanism 25 and the suction chamber 36.

The second compression mechanism 25 may include a third compression member and a fourth compression member that cooperate to define fluid pockets (i.e., compression pockets) therebetween. For example, the second compression mechanism 25 may be a co-rotating scroll compression mechanism in which the third compression member is a third scroll member (i.e., a driven scroll member) 148 and the fourth compression member is a fourth scroll member (i.e., an idler scroll member) 150. In other configurations, the second compression mechanism 25 could be another type of compression mechanism, such as an orbiting scroll compression mechanism, a rotary compression mechanism, a screw compression mechanism, a Wankel compression mechanism or a reciprocating compression mechanism, for example.

The third scroll member 148 may include a third end plate 152, a third spiral wrap 154 extending from one side of the third end plate 152, and a third hub 156 extending from the opposite side of the third end plate 152. The fourth scroll member 150 may include a fourth end plate 158, a fourth spiral wrap 160 extending from one side of the fourth end plate 158, and a fourth hub 162 extending from the opposite side of the fourth end plate 158. The third hub 156 of the third scroll member 148 is received within the central hub 138 of the third bearing housing 21 and is supported by the third bearing housing 21 and the fourth bearing 140 for rotation about a third rotational axis A3 relative to the second and third bearing housings 16, 21. In some configurations, the third rotational axis A3 may be collinear with the first rotational axis A1. The fourth hub 162 of the fourth scroll member 150 is received within the second central hub 64 of the second bearing housing 16 and is supported by the second bearing housing 16 and the third bearing 69 for rotation about a fourth rotational axis A4 relative to the second and third bearing housings 16, 21. The fourth rotational axis A4 is parallel to the third rotational axis A3 and is offset from the third rotational axis A3. In some configurations, the fourth rotational axis A4 may be collinear with the second rotational axis A2.

The third and fourth spiral wraps 154, 160 are intermeshed with each other and cooperate to form a plurality of fluid pockets (i.e., compression pockets) therebetween. Rotation of the third scroll member 148 about the third rotational axis A3 and rotation of the fourth scroll member 150 about the fourth rotational axis A4 causes the fluid pockets to decrease in size as they move from a radially outer position to a radially inner position, thereby compressing the working fluid therein.

The third scroll member 148 may include a suction inlet passage 164 that extends through the third end plate 152 and is in fluid communication with a radially outermost one of the fluid pockets defined by the spiral wraps 154, 160. The fourth scroll member 150 may include a discharge passage 166 that extends through the fourth end plate 158 and the fourth hub 162 and provides fluid communication between a radially innermost one of the fluid pockets and the suction inlet passage 88 in the second scroll member 70 (e.g., via the aperture 65 in the second bearing housing 16).

In some configurations, the second compression mechanism 25 could include an Oldham coupling (not shown) that may be keyed to the third and fourth end plates 152, 158 or keyed to the fourth end plate 158 and a rotor 172 of the second motor assembly 27 to transmit motion of the third scroll member 148 to the fourth scroll member 150. In other configurations, the second compression mechanism 25 may include a transmission mechanism that includes a plurality of pins 168 (FIG. 2) attached to and extending axially from the third end plate 152 of third scroll member 148. Each of the pins 168 may be received with an off-center aperture in a cylindrical disk 169 (FIG. 2; i.e., an aperture that that extends parallel to and offset from a longitudinal axis of the cylindrical disk 169). The disks 169 may be rotatably received in a corresponding one of a plurality of recesses (not shown; like recesses 94) formed in the fourth end plate 158 of the fourth scroll member 150.

The structure and function of the second motor assembly 27 may be similar or identical to that of the first motor assembly 20 described above, and therefore, will not be described again in detail. Briefly, the second motor assembly 27 may be a ring-motor and may include a composite stator 170 and the rotor 172. Like the rotor 98 of the first motor assembly 20, the rotor 172 of the second motor assembly 27 may be attached to the third scroll member 148 (e.g., via fasteners 174) and may surround the third and fourth end plates 152, 158 and the third and fourth spiral wraps 154, 160. Seals 176, 178 (like the seals 118, 120) engage the rotor 172 and the fourth end plate 158 of the fourth scroll member 150 and define an annular biasing chamber (like the annular chamber 122 described above).

With continued reference to FIGS. 1 and 2, operation of the compressor 10 will be described. Operation of the second motor assembly 27 causes rotation of the third and fourth scroll members 148, 150, as described above. Rotation of the third and fourth scroll members 148, 150 causes suction-pressure working fluid (i.e., working fluid at a low, first pressure) in the suction chamber 36 to be drawn through the apertures 142 in the third bearing housing 21 and into the second compression mechanism 25 (i.e., into the radially outermost compression pocket defined by the third and fourth spiral wraps 154, 160) through the suction inlet passage 164 in the third scroll member 148. In the second compression mechanism 25, the working fluid is compressed from the first pressure to a second pressure that is higher than the first pressure. The working fluid is discharged from the second compression mechanism 25 through the discharge passage 166 in the fourth scroll member 150.

Operation of the first motor assembly 20 causes rotation of the first and second scroll members 68, 70, as described above. Rotation of the first and second scroll members 68, 70 causes the working fluid at the second pressure in the discharge passage 166 to be drawn through the aperture 65 in the second bearing housing 16, through the suction inlet passage 88 in the second scroll member 70, and into the first compression mechanism 18 (i.e., into the radially outermost compression pocket defined by the first and second spiral wraps 74, 80). In the first compression mechanism 18, the working fluid is further compressed from the second pressure to a third pressure that is higher than the second pressure. The working fluid at the third pressure is discharged from the first compression mechanism 18 through the discharge passage 90 in the first scroll member 68.

The working fluid at the third pressure in the discharge passage 90 may flow through the discharge valve assembly 54, through the discharge pipe 33 and into the discharge chamber 30. From the discharge chamber 30, the working fluid may exit the compressor through the discharge outlet fitting 32.

While the compressor 10 described above and shown in the figures include two compression mechanisms and two motor assemblies, in some configurations, the compressor 10 could include more than two compression mechanisms and more than two motor assemblies. The configuration of the compressor 10 described above allows multiple independently operable compression mechanisms 18, 25 and multiple independently operable motor assemblies 20, 27 to be packaged within the single shell assembly 12. In particular, the structure of the bearing housings 14, 16, 21, the motor assemblies 20, 27 and the compression mechanisms 18, 25 allows for the multiple, independently operable compression mechanisms and motor assemblies to be packaged within a single shell assembly while maintaining a reasonably compact overall size of the compressor.

The compression mechanisms 18, 25 may have the same capacities or different capacities. Both of the motor assemblies 20, 27 may be fixed-speed motors, both of the motor assemblies 20, 27 may be variable-speed motors, or one of the motor assemblies 20, 27 may be a fixed-speed motor and the other of the motor assemblies 20, 27 may be a variable-speed motor. The motor assemblies 20, 27 may be operable independently of each other, and therefore, can be operable at the same speed or at different speeds. Furthermore, in some configurations, one or both of the compression mechanisms 18, 25 can be equipped with capacity modulation means (e.g., vapor injection, modulated suction valves, variable-volume ratio vales, etc.).

Figure 3:
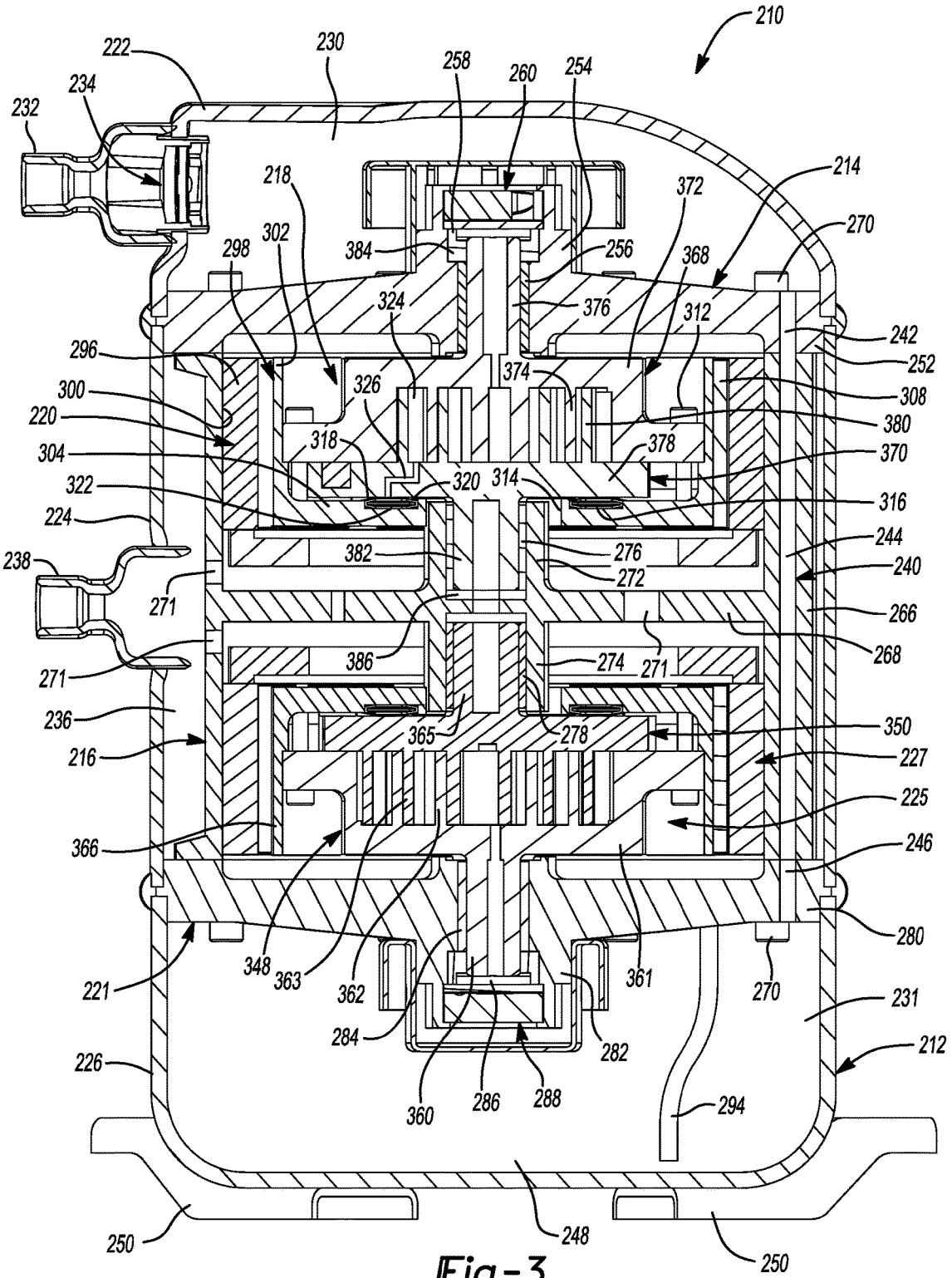
FIG. 3 is a cross-sectional view of another compressor according to the principles of the present disclosure.
Figure 4:
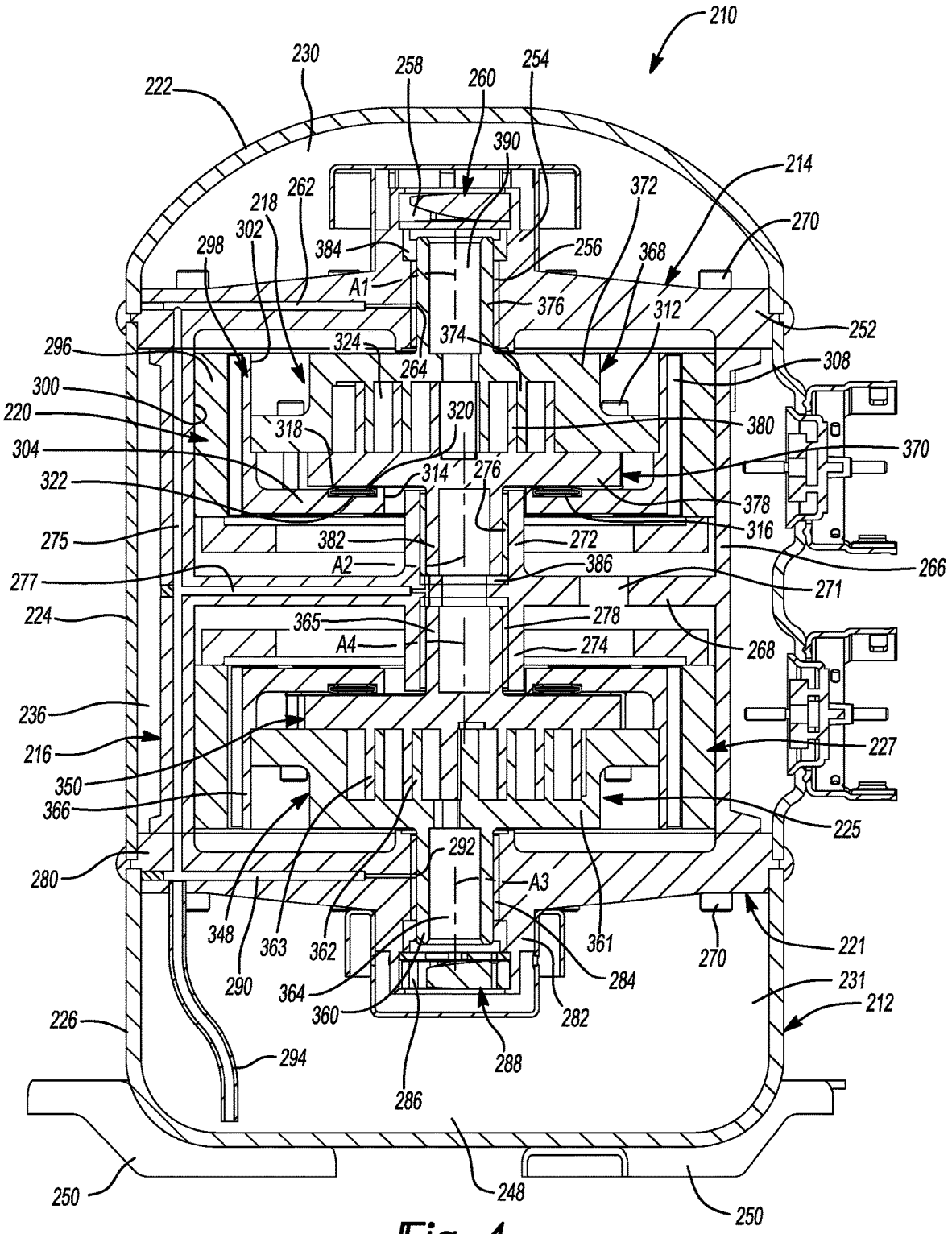
FIG. 4 is another cross-sectional view of the compressor of FIG. 3.

With reference to FIGS. 3 and 4, another compressor 210 is provided that may include a shell assembly 212, a first bearing housing 214, a second bearing housing 216, a first compression mechanism 218, a first motor assembly 220, a third bearing housing 221, a second compression mechanism 225, and a second motor assembly 227. The shell assembly 212 may include a first shell body 222, a second shell body 224 and a third shell body 226. The first and second shell bodies 222, 224 may be fixed to the first bearing housing 214 and to each other (e.g., with the first shell body 222 stacked on top of the second shell body 224). The first shell body 222 and the first bearing housing 214 may cooperate with each other to define a first discharge chamber 230. The first bearing housing 214 may sealingly engage the first and second shell bodies 222, 224 to seal the first discharge chamber 230 within the first shell body 222. A discharge outlet fitting 232 (FIG. 3) may engage the first shell body 222 and may be in fluid communication with the first discharge chamber 230.

Discharge-pressure working fluid (i.e., working fluid at a higher pressure than suction pressure) may enter the first discharge chamber 230 from the first compression mechanism 218 and/or the second compression mechanism 225 and may exit the compressor 210 through the discharge outlet fitting 232. In some configurations, a discharge valve 234 may be disposed within the discharge outlet fitting 232. The discharge valve 234 may be a check valve that allows fluid to exit the first discharge chamber 230 through the discharge outlet fitting 232 and prevents fluid from entering the first discharge chamber 230 through the discharge outlet fitting 232. In some configurations, the first shell body 222 and the first bearing housing 214 may define a lubricant sump disposed in the first discharge chamber 230.

The second and third shell bodies 224, 226 may be fixed to the third bearing housing 221 and to each other (e.g., with the second shell body 224 stacked on top of the third shell body 226). The second shell body 224 and the first and second bearing housings 214, 216 may cooperate with each other to define a suction chamber 236 in which the second bearing housing 216 and the first and second motor assemblies 220, 227 may be disposed. A suction inlet fitting 238 (FIG. 3) may engage the second shell body 224 and may be in fluid communication with the suction chamber 236. Suction-pressure working fluid (i.e., low-pressure working fluid) may enter the suction chamber 236 through the suction inlet fitting 238 and may be drawn into the first and second compression mechanisms 218, 225 for compression therein.

The third bearing housing 221 and the third shell body 226 may cooperate with each other to define a second discharge chamber 231 that receives working fluid discharged from the second compression mechanism 225. The suction chamber 236 is disposed axially between (i.e., in a direction extending along or parallel to rotational axes of the compression mechanisms 218, 225) the first discharge chamber 230 and the second discharge chamber 231. The first bearing housing 214 may sealingly engage the first and second shell bodies 222, 224 and the third bearing housing 221 may sealingly engage the second and third shell bodies 224, 226 to seal the suction chamber 236 within the second shell body 224 and fluidly isolate the suction chamber 236 from the first and second discharge chambers 230, 231.

A discharge conduit 240 (FIG. 3) may extend through the suction chamber 236 and may be fluidly isolated from the suction chamber 236 and in fluid communication with the first and second discharge chambers 230, 231. In this manner, the discharge conduit 240 allows working fluid discharged from the second compression mechanism 225 to flow from the second discharge chamber 231 to the first discharge chamber 230. In some configurations, the discharge conduit 240 includes a first passage 242 that extends through the first bearing housing 214, a second passage 244 that extends through the second bearing housing 216, and a third passage 246 that extends through the third bearing housing 221, as shown in FIG. 3.

In some configurations, the third shell body 226 may define a lubricant sump 248 disposed in the second discharge chamber 231. The third shell body 226 may include feet (or mounting flanges) 250 and may define a base of the shell assembly 212.

The first bearing housing 214 may be a generally disk-shaped member having an outer rim 252 that may be welded and/or otherwise fixedly attached to the first and second shell bodies 222, 224. The first bearing housing 214 may also include a central hub 254 that receives a first bearing 256 and defines a discharge passage 258. The discharge passage 258 is in fluid communication with the first discharge chamber 230 and the first compression mechanism 218. A discharge valve assembly 260 may be disposed within the discharge passage 258. The discharge valve assembly 260 allows compressed working fluid discharged from the first compression mechanism 218 to flow through the discharge passage 258 and into the first discharge chamber 230 and prevents working fluid in the first discharge chamber 230 from flowing into the first compression mechanism 218.

As shown in FIG. 4, the first bearing housing 214 may include a first radially extending lubricant passage 262 in fluid communication with an aperture 264 in the first bearing 256. The first radially extending lubricant passage 262 may be in fluid communication with the lubricant sump 248 and may provide lubricant to the first bearing 256 via the aperture 264.

The second bearing housing 216 may be a generally cylindrical member having an annular outer wall 266 and a flange 268 extending radially inward from the annular outer wall 266. Opposite axial ends of the annular outer wall 266 are attached to the first and third bearing housings 214, 221, respectively, via fasteners 270, for example. The first compression mechanism 218 and the first motor assembly 220 may be disposed within the second bearing housing 216 (i.e., axially between the flange 268 and the first bearing housing 214). The second compression mechanism 225 and the second motor assembly 227 may be disposed within the second bearing housing 216 (i.e., axially between the flange 268 and the third bearing housing 221). As shown in FIG. 3, the annular outer wall 266 and the flange 268 may include apertures 271 to allow suction-pressure working fluid in the suction chamber 236 to flow to the first and second compression mechanisms 218, 225 and the first and second motor assemblies 220, 227. The flange 268 may include a first central hub 272 and a second central hub 274. The first and second central hubs 272, 274 may extend from the flange 268 in opposite axial directions. The first and second central hubs 272, 274 may receive second and third bearings 276, 278, respectively.

As shown in FIG. 4, the annular outer wall 266 may include an axially extending lubricant passage 275, and the flange 268 may include a second radially extending lubricant passage 277. The axially extending lubricant passage 275 may be in fluid communication with the first and second radially extending lubricant passages 262, 277 and the lubricant sump 248. The second radially extending lubricant passage 277 may provide lubricant from the lubricant sump 248 to the second and third bearings 276, 278.

The third bearing housing 221 may be a generally disk-shaped member having an outer rim 280 that may be welded and/or otherwise fixedly attached to the second and third shell bodies 224, 226. The third bearing housing 221 may also include a central hub 282 that receives a fourth bearing 284 and defines a discharge passage 286. The discharge passage 286 is in fluid communication with the second discharge chamber 231 and the second compression mechanism 225. A discharge valve assembly 288 may be disposed within the discharge passage 286. The discharge valve assembly 288 allows compressed working fluid discharged from the second compression mechanism 225 to flow through the discharge passage 286 and into the second discharge chamber 231 and prevents working fluid in the second discharge chamber 231 from flowing into the second compression mechanism 225.

As shown in FIG. 4, the third bearing housing 221 may include a third radially extending lubricant passage 290 in fluid communication with an aperture 292 in the fourth bearing 284. The third radially extending lubricant passage 290 may be in fluid communication with the lubricant sump 248 (via lubricant tube 294) and the axially extending lubricant passage 275. The third radially extending lubricant passage 290 may provide lubricant to the fourth bearing 284 via the aperture 292. High-pressure working fluid in the second discharge chamber 231 may force lubricant in the lubricant sump 248 up through the lubricant tube 294 and through the lubricant passages 290, 275, 277, 262 to lubricate bearings 256, 276, 278, 284.

The first compression mechanism 218 may include a first compression member and a second compression member that cooperate to define fluid pockets (i.e., compression pockets) therebetween. For example, the first compression mechanism 218 may be a co-rotating scroll compression mechanism in which the first compression member is a first scroll member (i.e., a driven scroll member) 368 and the second compression member is a second scroll member (i.e., an idler scroll member) 370. In other configurations, the first compression mechanism 218 could be another type of compression mechanism, such as an orbiting scroll compression mechanism, a rotary compression mechanism, a screw compression mechanism, a Wankel compression mechanism or a reciprocating compression mechanism, for example.

The first scroll member 368 may include a first end plate 372, a first spiral wrap 374 extending from one side of the first end plate 372, and a first hub 376 extending from the opposite side of the first end plate 372. The second scroll member 370 may include a second end plate 378, a second spiral wrap 380 extending from one side of the second end plate 378, and a second hub 382 extending from the opposite side of the second end plate 378. The first hub 376 of the first scroll member 368 is received within the central hub 254 of the first bearing housing 214 and is supported by the first bearing housing 214 and the first bearing 256 for rotation about a first rotational axis A1 relative to the first and second bearing housings 214, 216. A seal 384 is disposed within the central hub 254 and sealing engages the central hub 254 and the first hub 376. The second hub 382 of the second scroll member 370 is received within the first central hub 272 of the second bearing housing 216 and is supported by the second bearing housing 216 and the second bearing 276 for rotation about a second rotational axis A2 relative to the first and second bearing housings 214, 216. The second rotational axis A2 is parallel to first rotational axis A1 and is offset from the first rotational axis A1. A thrust bearing 386 may be disposed within the first central hub 272 of the second bearing housing 216 and may support an axial end of the second hub 382 of the second scroll member 370.

The first and second spiral wraps 374, 380 are intermeshed with each other and cooperate to form a plurality of fluid pockets (i.e., compression pockets) therebetween. Rotation of the first scroll member 368 about the first rotational axis A1 and rotation of the second scroll member 370 about the second rotational axis A2 causes the fluid pockets to decrease in size as they move from a radially outer position to a radially inner position, thereby compressing the working fluid therein. In some configurations, the first compression mechanism 218 could include an Oldham coupling or any other transmission mechanism to transmit motion of the first scroll member 368 to the second scroll member 370, as described above.

The first scroll member 368 may include a suction inlet passage (not shown) that may extend through the first end plate 372, for example, and is in fluid communication with a radially outermost one of the fluid pockets defined by the spiral wraps 374, 380. The first scroll member 368 may also include a discharge passage 390 (FIG. 4) that extends through the first end plate 372 and the first hub 376 and provides fluid communication between a radially innermost one of the fluid pockets and the first discharge chamber 230 (e.g., via the discharge passage 258).

The first motor assembly 220 may be a ring-motor and may include a composite stator 296 and a rotor 298. The stator 296 may be an annular member fixed to an inner diametrical surface 300 of the annular outer wall 266 of the second bearing housing 216. The stator 296 may surround the first and second end plates 372, 378 and the first and second spiral wraps 374, 380.

The rotor 298 may be disposed radially inside of the stator 296 and is rotatable relative to the stator 296. The rotor 298 may include an annular axially extending portion 302 that extends parallel to the first rotational axis A1 and a radially extending portion 304 that extends radially inward (i.e., perpendicular to the first rotational axis A1) from an axial end of the axially extending portion 302. The axially extending portion 302 may surround the first and second end plates 372, 378 and the first and second spiral wraps 374, 380. An inner diametrical surface of the axially extending portion 302 may engage an outer periphery of the first end plate 372. Magnets 308 may be fixed to an outer diametrical surface of the axially extending portion 302. Fasteners 312 may engage the radially extending portion 304 and the first end plate 372 to rotationally and axially fix the rotor 298 to the first scroll member 368. Therefore, when electrical current is provided to the stator 296, the rotor 298 and the first scroll member 368 rotate about the first rotational axis A1. Such rotation of the first scroll member 368 causes corresponding rotation of the second scroll member 370 about the second rotational axis A2.

The radially extending portion 304 of the rotor 298 may include a central aperture 314 through which the second hub 382 of the second scroll member 370 extends. The radially extending portion 304 may also include an annular recess 316 that surrounds the central aperture 314 and the first and second rotational axes A1, A2. A first annular seal 318 and a second annular seal 320 may be at least partially received in the recess 316 and may sealingly engage the radially extending portion 304 and the second end plate 378. The first annular seal 318 may surround the second annular seal 320. In this manner, the first and second annular seals 318, 320, the second end plate 378 and the radially extending portion 304 cooperate to define an annular chamber 322. The annular chamber 322 may receive intermediate-pressure working fluid (at a pressure greater than a pressure of working fluid received by the first compression mechanism 218 and less than a pressure of working fluid discharged from the first compression mechanism 218) from an intermediate fluid pocket 324 via a passage 326 (FIG. 3) in the second end plate 378. Intermediate-pressure working fluid in the annular chamber 322 biases the second end plate 378 in an axial direction (i.e., a direction parallel to the rotational axes A1, A2) toward the first end plate 372 to improve the seal between tips of the first spiral wrap 374 and the second end plate 378 and the seal between tips of the second spiral wrap 380 and the first end plate 372.

The structure and function of the second compression mechanism 225 and the second motor assembly 227 may be similar or identical to that of the first compression mechanism 218 and the first motor assembly 220, respectively, and therefore, will not be described again in detail. Briefly, the second compression mechanism 225 may be a co-rotating scroll compression mechanism including a third compression member, which may be a third scroll member (i.e., a driven scroll member) 348, and a fourth compression member, which may be a fourth scroll member (i.e., an idler scroll member) 350. The third scroll member 348 may be similar or identical to the first scroll member 368, and the fourth scroll member 350 may be similar or identical to the second scroll member 370.

A third hub 360 of the third scroll member 348 may be received in the central hub 282 of the third bearing housing 221 and is supported by the third bearing housing 221 and the fourth bearing 284 for rotation about a third rotational axis A3 relative to the third bearing housing 221. Like the first scroll member 368, the third scroll member 348 may include a suction inlet passage (not shown) that extends through a third end plate 361 of the third scroll member 348 and is in fluid communication with the suction chamber 236 and a radially outermost compression pocket defined by third and fourth spiral wraps 362, 363 of the third and fourth scroll members 348, 350, respectively. The third scroll member 348 may also include a discharge passage 364 (FIG. 4) that extends through the third end plate 361 and the third hub 360 and is in fluid communication with a radially innermost compression pocket and the second discharge chamber 231. A fourth hub 365 of the fourth scroll member 350 may be received in the second central hub 274 of the second bearing housing 216 and is supported by the second bearing housing 216 and the third bearing 278 for rotation about a fourth rotational axis A4 relative to the second bearing housing 216. The third and fourth rotational axes A3, A4 are parallel to each other and offset from each other. In some configurations, the first and third rotational axes A1, A3 may be collinear with each other, and the second and fourth rotational axes A2, A4 may be collinear with each other. A rotor 366 of the second motor assembly 227 may fixedly engage the third end plate 361 such that the third scroll member 348 rotates with the rotor 366 about the third rotational axis A3. Such rotation of the third scroll member 348 causes corresponding rotation of the fourth scroll member 350 about the fourth rotational axis A4.

During operation of the first and second motor assemblies 220, 227, suction-pressure working fluid may be drawn into the first and second compression mechanisms 218, 225 through the suction inlet passages (not shown) in the first and third end plates 372, 361. Working fluid compressed in the first compression mechanism 218 is discharged through the discharge passage 390 into the first discharge chamber 230. Working fluid compressed in the second compression mechanism 225 is discharged through the discharge passage 364 into the second discharge chamber 231. The compressed working fluid in the second discharge chamber 231 flows to the first discharge chamber 230 through the discharge conduit 240. Working fluid in the first discharge chamber 230 may exit the compressor 210 through the discharge outlet fitting 232.

The first and second motor assemblies 220, 227 are operable independently of each other, and the first and second compression mechanisms 218, 225 are operable in parallel, rather than in series or in stages. Therefore, the compressor is operable in a first mode, in which the first and second motor assemblies 220, 227 can both be operated concurrently (such that both of the first and second compression mechanisms 218, 225 operate concurrently), and in a second mode, in which only one of the first and second motor assemblies 220, 227 operates at a given time (such that only one of the first and second compression mechanisms 218, 225 operates at a given time). The motor assemblies 220, 227 can operate at different speeds or at the same speed. One or both of the motor assemblies 220, 227 may be a variable-speed or multi-speed motor and/or one or both of the motor assemblies 220, 227 may be a fixed-speed motor. The first and second compression mechanisms 218, 225 may have the same capacities or different capacities. Furthermore, in some configurations, the capacities of one or both of the compression mechanisms 218, 225 may be modulated (e.g., by vapor injection, variable-volume ratio valves, modulated suction, etc.).

The entire disclosures of each of Applicant's commonly owned U.S. Patent Application Publication No. 2018/0223843, U.S. Patent Application Publication No. 2018/0223848, U.S. Patent Application Publication No. 2018/0224171, and U.S. Patent Application Publication No. 2018/0223849 are incorporated herein by reference.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

a first compression mechanism disposed within the shell and including a first compression member that is rotatable relative to the shell about a first rotational axis and a second compression member that is rotatable relative to the shell about a second rotational axis that is parallel to and offset from the first rotational axis;

a first motor assembly disposed within the shell and including a first rotor attached to the first compression member and surrounding the first and second compression members;

a second compression mechanism disposed within the shell and including a third compression member that is rotatable relative to the shell about a third rotational axis and a fourth compression member that is rotatable relative to the shell about a fourth rotational axis that is parallel to and offset from the third rotational axis;

a second motor assembly disposed within the shell and including a second rotor attached to the third compression member and surrounding the third and fourth compression members, wherein the first and second rotors each include a radially extending portion that extends radially outward relative to the first rotational axis and an axially extending portion that extends parallel to the first rotational axis, wherein the axially extending portion of the first rotor engages the first compression member and surrounds the second compression member, and wherein the axially extending portion of the second rotor engages the third compression member and surrounds the fourth compression member;

a first seal engaging the second compression member and the radially extending portion of the first rotor; and a second seal engaging the fourth compression member and the radially extending portion of the second rotor, wherein the radially extending portions of the first and second rotors are disposed axially between end plates of the second and fourth compression members.

2. The compressor of claim 1, wherein the first, second, third and fourth compression members are scroll members each having an end plate and a spiral wrap extending from the end plate.

3. The compressor of claim 1, wherein the first and third rotational axes are collinear, and wherein the second and fourth rotational axes are collinear.

4. The compressor of claim 1, wherein the first and second motor assemblies are operable independently of each other, and wherein the first and second rotors are rotatable independently of each other.

5. The compressor of claim 1, wherein the first compression mechanism receives and further compresses fluid discharged from the second compression mechanism.

6. The compressor of claim 5, further comprising:

a first bearing housing disposed within the shell and rotatably supporting a first hub of the first compression member;

a second bearing housing disposed within the shell and rotatably supporting a second hub of the second compression member and a fourth hub of the fourth compression member; and a third bearing housing disposed within the shell and rotatably supporting a third hub of the third compression member.

7. The compressor of claim 6, wherein the fourth hub of the fourth compression member includes a discharge passage through which fluid compressed by the second compression mechanism flows, wherein the second hub of the second compression member includes an inlet passage that receives fluid from the discharge passage, and wherein the second bearing housing includes an aperture that provides fluid communication between the discharge passage and the inlet passage.

8. The compressor of claim 7, wherein an end plate of the second compression member includes a radially extending passage in fluid communication with the inlet passage and a pocket defined by spiral wraps of the first and second compression members.

9. The compressor of claim 1, further comprising:

a first bearing housing disposed within the shell and rotatably supporting a first hub of the first compression member;

a second bearing housing disposed within the shell and rotatably supporting a second hub of the second compression member and a fourth hub of the fourth compression member; and a third bearing housing disposed within the shell and rotatably supporting a third hub of the third compression member, wherein the first bearing housing cooperates with the shell to define a first discharge chamber receiving fluid discharged by the first compression mechanism, and wherein the third bearing housing cooperates with the shell to define a second discharge chamber receiving fluid discharged by the second compression mechanism.

10. The compressor of claim 9, wherein the first and third bearing housings cooperate to define a suction chamber therebetween, and wherein the first and second compression mechanisms receive fluid from the suction chamber at a pressure that is lower than a pressure of the fluid in at least one of the first and second discharge chambers.

11. The compressor of claim 10, further comprising a discharge conduit extending through the suction chamber and providing fluid communication between the first and second discharge chambers.

12. The compressor of claim 10, wherein the shell defines a lubricant sump disposed in the second discharge chamber, and wherein the first, second and third bearing housings include lubricant passages in fluid communication with the lubricant sump and providing lubricant to the first, second, third and fourth compression members.

13. A compressor comprising:

a shell;

a first compression mechanism disposed within the shell and including a first compression member that is rotatable relative to the shell about a first rotational axis and a second compression member that is rotatable relative to the shell about a second rotational axis that is parallel to and offset from the first rotational axis;

a first bearing housing fixed relative to the shell and rotatably supporting a first hub of the first compression member;

a second bearing housing fixed relative to the shell and rotatably supporting a second hub of the second compression member;

a first motor assembly disposed between the first and second bearing housings and including a first rotor attached to the first compression member;

a second compression mechanism disposed within the shell and including a third compression member that is rotatable relative to the shell about a third rotational axis and a fourth compression member that is rotatable relative to the shell about a fourth rotational axis that is parallel to and offset from the third rotational axis, the fourth compression member including a fourth hub that is rotatably supported by the second bearing housing;

a third bearing housing fixed relative to the shell and rotatably supporting a third hub of the third compression member; and a second motor assembly disposed between the second and third bearing housings and including a second rotor attached to the third compression member.

14. The compressor of claim 13, wherein the first and third rotational axes are collinear, and wherein the second and fourth rotational axes are collinear.

15. The compressor of claim 13, wherein the first and second motor assemblies are operable independently of each other, and wherein the first and second rotors are rotatable independently of each other.

16. The compressor of claim 13, wherein the first, second, third and fourth compression members are scroll members each having an end plate and a spiral wrap extending from the end plate.

17. The compressor of claim 13, wherein the first rotor surrounds the first and second compression members, and wherein the second rotor surrounds the third and fourth compression members.

18. The compressor of claim 13, wherein the first compression mechanism receives and further compresses fluid discharged from the second compression mechanism.

19. The compressor of claim 18, wherein the fourth hub of the fourth compression member includes a discharge passage through which fluid compressed by the second compression mechanism flows, wherein the second hub of the second compression member includes an inlet passage that receives fluid from the discharge passage, and wherein the second bearing housing includes an aperture that provides fluid communication between the discharge passage and the inlet passage.

20. The compressor of claim 19, wherein an end plate of the second compression member includes a radially extending passage in fluid communication with the inlet passage and a pocket defined by spiral wraps of the first and second compression members.

21. The compressor of claim 13, wherein the first bearing housing cooperates with the shell to define a first discharge chamber receiving fluid discharged by the first compression mechanism, and wherein the third bearing housing cooperates with the shell to define a second discharge chamber receiving fluid discharged by the second compression mechanism.

22. The compressor of claim 21, wherein the first and third bearing housings cooperate to define a suction chamber therebetween, and wherein the first and second compression mechanisms receive fluid from the suction chamber at a pressure that is lower than a pressure of the fluid in at least one of the first and second discharge chambers.

23. The compressor of claim 22, wherein the shell defines a lubricant sump disposed in the second discharge chamber, and wherein the first, second and third bearing housings include lubricant passages in fluid communication with the lubricant sump and providing lubricant to the first, second, third and fourth compression members.

24. A compressor comprising:

a shell;

a first compression mechanism disposed within the shell and including a first compression member that is rotatable relative to the shell about a first rotational axis and a second compression member that is rotatable relative to the shell about a second rotational axis that is parallel to and offset from the first rotational axis;

a first motor assembly disposed within the shell and including a first rotor attached to the first compression member and surrounding the first and second compression members;

a second compression mechanism disposed within the shell and including a third compression member that is rotatable relative to the shell about a third rotational axis and a fourth compression member that is rotatable relative to the shell about a fourth rotational axis that is parallel to and offset from the third rotational axis;

a second motor assembly disposed within the shell and including a second rotor attached to the third compression member and surrounding the third and fourth compression members;

a first bearing housing disposed within the shell and rotatably supporting a first hub of the first compression member;

a second bearing housing disposed within the shell and rotatably supporting a second hub of the second compression member and a fourth hub of the fourth compression member; and a third bearing housing disposed within the shell and rotatably supporting a third hub of the third compression member, wherein the first bearing housing cooperates with the shell to define a first discharge chamber receiving fluid discharged by the first compression mechanism, and wherein the third bearing housing cooperates with the shell to define a second discharge chamber receiving fluid discharged by the second compression mechanism, wherein the first and third bearing housings cooperate to define a suction chamber therebetween, and wherein the first and second compression mechanisms receive fluid from the suction chamber at a pressure that is lower than a pressure of the fluid in at least one of the first and second discharge chambers, and wherein a discharge conduit extends through the suction chamber and provides fluid communication between the first and second discharge chambers.

25. The compressor of claim 24, wherein the discharge conduit includes a first passage formed in the first bearing housing, a second passage formed in the second bearing housing, and a third passage formed in the third bearing housing.

* * * * *